United States Patent [19]

Rivoire

[11] 4,314,459

[45] Feb. 9, 1982

[54] STABLE AND PRECISE CRYOGENIC DEVICE

[76] Inventor: Jacques Rivoire, 1201 Rue Rocqueturiere, Mas Albine, 34000 Montpellier, France

[21] Appl. No.: 163,798

[22] Filed: Jun. 27, 1980

[30] Foreign Application Priority Data

Jun. 28, 1979 [FR] France ..... 79 17285

[51] Int. Cl.[3] ..... F25D 19/00

[52] U.S. Cl. ..... 62/514 R; 62/78; 165/30

[58] Field of Search ..... 62/78, 514 R; 165/30; 435/2

[56] References Cited

U.S. PATENT DOCUMENTS

| | | | |
|---|---|---|---|
| 2,988,898 | 6/1961 | Hesson et al. | 62/514 R |
| 3,195,620 | 7/1965 | Steinhardt, Jr. | 62/514 R |
| 3,305,000 | 2/1967 | Bullen et al. | 62/514 R |
| 3,410,110 | 11/1968 | Hoyes | 62/514 R |
| 3,447,333 | 6/1969 | Goodstein | 62/514 R |
| 3,894,403 | 7/1975 | Longsworth | 62/514 R |
| 3,938,346 | 2/1976 | Ovchinnikov et al. | 62/514 R |
| 4,030,314 | 6/1977 | Strehler et al. | 62/78 |
| 4,107,937 | 8/1978 | Chmiel | 62/78 |
| 4,232,453 | 11/1980 | Edelmann | 62/514 R |

*Primary Examiner*—Ronald C. Capossela
*Attorney, Agent, or Firm*—Karl F. Ross

[57] ABSTRACT

A cryogenic cooler, e.g. for medical specimen or other samples or materials to be brought to temperatures below $\phi$° C., comprises a stable and precise cryogenic device in which a liquefied gas is continuously vaporized in the absence of a free surface of a bath of the liquid, the vessel being a Dewar receptacle open to the atmosphere whereby a slight atmospheric pressure excludes moisture-carrying air and thus prevents ice deposits in the vessel or on the sample.

13 Claims, 6 Drawing Figures

STABLE AND PRECISE CRYOGENIC DEVICE

FIELD OF THE INVENTION

My present invention relates to a cryogenic device and, more particularly, to an apparatus for maintaining a predetermined subzero temperature for a sample or specimen using cryogenic fluids, i.e. a liquified gas such as nitrogen or liquid air.

BACKGROUND OF THE INVENTION

Cryogenic devices have been provided heretofore for a variety of purposes and the particular type of cryogenic devices with which the present invention is concerned, is a device which can be used for conducting low temperature experiments, for subjecting samples, specimens and test objects to low temperatures and for treating materials with low temperatures selected between say 0° C. and the boiling point of a liquid cryogen, i.e. a liquefied gas such as nitrogen or air. It is desirable with devices of the latter type to enable them to operate at any preselected temperature within this range and to hold the temperature stable for long periods of time.

Such devices are required for medical, scientific or industrial research and have generally comprised a vessel containing liquefied air or liquefied nitrogen into which the object to be treated is immersed directly or indirectly, i.e. in another sample-holding vessel so that the object is eventually able to be brought to a temperature approximating the boiling point or liquefaction point of the cryogen.

Obviously, if the temperature is determined only by the boiling point of the liquid cryogen, the device is suitable only to maintain this temperature, the liquid cryogen being replaced as it evaporates.

Thus the temperature which can be achieved with such a device is always the lowest temperature which results from the evaporation of the particular liquefied gas.

In order to adjust the temperature of the sample it has been proposed to surround the sample tube with an electric resistance heater which can supply to the sample the calories required to maintain it at a temperature above the boiling point of the free liquid in the vessel. The result is a thermal equilibrium between the liquefied gas and the sample controlled by the resistance heater.

Devices of this type have been found to be somewhat imprecise as a result of the poor distribution of heat to the sample from the resistance heater. Thus lower portions of the sample, bathed in the liquefied gas, are generally at a substantially lower temperature than upper portions of the sample surrounded by the electrical resistance heater. The thermal exchange between the two parts of the sample is certainly not instantaneous and frequently is relatively slow.

To obtain a better distribution of temperature, it has also been proposed to apply the resistance heater not only along the portion of the sample tube above the free surface of the liquid, but over the entire area of the sample tube. While this successfully improved the distribution within the sample, it, too, has a significant disadvantage. It is found, for example, that the thermal expansion and contraction to which the heater is subject because of the large temperature differentials to which it is exposed each time a sample is to be cooled, damage the heater. In fact, the mere energization and deenergization of the heater will bring about similar expansion and contraction to the detriment of this fragile unit.

In both of the cases described, the possibility of controlling the temperature is found to be limited also by the thermal inertia of the mass of liquid in which the sample is immersed. The liquefied gas has frequently far more mass than the sample and thus attempts to control finely the sample temperature are impeded by the thermal inertia of the liquid mass.

In another known system, the electric resistance heater for controlling the temperature surrounds the sample tube and the sample tube is not permitted to contact the liquefied gas directly. The resistance heater lines the inner wall of a receptacle in the center of which is placed the sample holder. This receptacle is, in turn, immersed in a much larger vessel containing a fixed volume of the liquefied gas, the latter being replenished as evaporation occurs.

Here again control of the temperature is obtained by supplying calories to a greater or lesser extent to balance the heat abstracted by the liquefied gas. While mechanically this system is more desirable than the earlier systems, the thermal energy which must be introduced to maintain a given temperature or for a given sample, is significantly higher.

Furthermore, the receptacle containing the resistance heater and the sample is always at atmospheric pressure and ambient air, carrying moisture, can diffuse into this receptacle or can be drawn into the latter by convection currents, thereby depositing ice on the sample tube or elsewhere in this receptacle.

Thus prior art devices for the purposes described have not been found to be fully satisfactory.

OBJECTS OF THE INVENTION

It is the principal object of the present invention to provide an improved cryogenic device which can be operated with a high degree of temperature stability for long periods of time without the disadvantages of earlier devices for the same purpose.

Another object of the invention is to provide a cryogenic apparatus capable of maintaining a selectable temperature less than 0° C. for a medical, scientific or industrial sample without high energy cost and with a high degree of precision.

A further object of my invention is to provide a sample-cooling device operable at cryogenic temperatures which is free from the icing conditions described above.

SUMMARY OF THE INVENTION

These objects and others which will become apparent hereinafter are attained, in accordance with the present invention, in a system in which the reduction of the sample temperature is not brought about by evaporation of a mass of liquefied gas in which the sample is immersed directly or with interposition of an intermediate receptacle. Further, the control of the temperature is not a function of compensatory supply of greater or lesser quantities of heat to the sample from an electric resistance surrounding same.

On the contrary, the present invention provides for the reduction of the temperature of the sample in a vessel provided with an evaporator to which the liquefied gas is continuously fed and from which this cryogen, in its gaseous state, fills the vessel upon emergence from the evaporator or expander, thereby bathing the sample container in cold gas in the absence of any liquid phase, while generating a slight superatmospheric pressure in the vessel to exclude air and moisture, thereby preventing icing.

Thus the cooling is effected by the continuous evaporation of the liquid cryogen into the vessel which can communicate with the atmosphere without any danger of icing; the temperature control is a function of the supply of the liquid phase to the evaporator at a rate required by the cold demand to maintain and attain the desired temperature.

According to the invention, the evaporator is disposed adjacent and connected to a diffuser forming an envelope open toward the atmosphere and at the center of which the sample or sample holder can be placed.

This entire assembly is disposed in an insulated receptacle of the double-wall type, i.e. a Dewar receptacle, which is also open to the atmosphere.

Thus, whereas the evaporation rate is reasonably constant from the free surface of a bath of liquid in prior art devices in which a sample is immersed, thereby rendering the temperature control imprecise, there is no free surface of a liquefied gas mass in the system of the present invention since the rate of evaporation in the evaporator of the present invention is a function of the rate at which liquid is fed thereto and this can easily be controlled in response to a temperature measurement.

Thus the device of the instant invention controls the temperature of a sample by the control of the quantity of liquefied gas fed to the evaporator and evaporated at any instant at the evaporator as a function of the difference between the actual temperature and the desired temperature.

Compensatory heating of the sample is completely eliminated and no resistance heater is required in the region of the sample vessel or those parts of the apparatus exposed to the lowest temperatures. Consequently, the mechanical effects on resistance heaters are eliminated as well.

It should also be noted that the thermal inertia of the system is minimal because the mass of liquid, from the surface over which evaporation occurs, is likewise eliminated.

Since the continuous feed of liquid and continuous evaporation thereof results in a continuous flow of the gasified cryogen from the receptacle, it is always at a pressure corresponding to the vapor pressure of the cryogen and slightly greater than atmospheric pressure. All influx of humid air is precluded and hence ice cannot form on the inner walls of the receptacle or on the sample tube or any of the other parts of the apparatus.

However, as the cold gas leaves the mouth of the vessel it meets air at a temperature below dewpoint and in this case ice can form at the mouth of the receptacle. This can be avoided according to the invention, by providing an electrical resistance heated sleeve adjacent the mouth of the receptacle.

Experiments have shown that the cryogenic device described can maintain temperatures between 0° C. and the boiling point of the liquid cryogen accurately to a precision of 0.1° C. solely by controlling the liquid feed to the evaporator.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
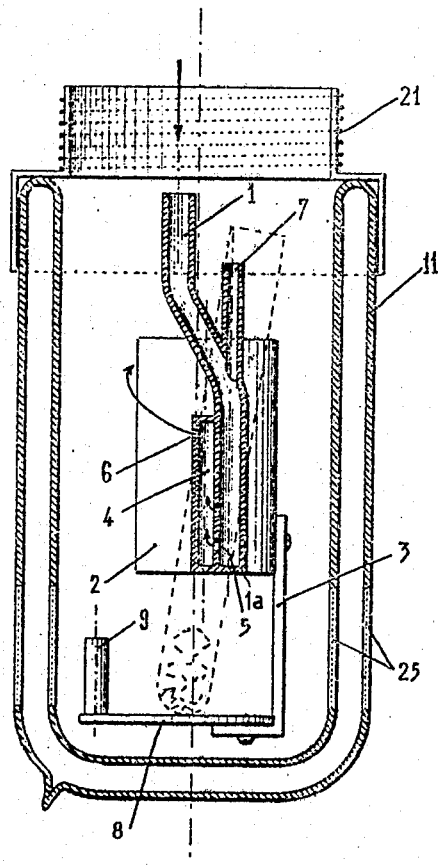
FIG. 1 is a schematic vertical cross-sectional view of a device according to the invention, the diffuser being shown in elevation.
Figure 2:
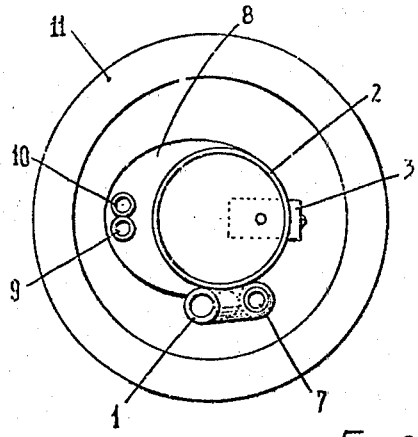
FIG. 2 is a plan view of the device as seen from above.

As can be seen from FIGS. 1 and 2, the cryogenic device of the present invention comprises an injector 1 in the form of a vertical tube closed at its base 1*a* and communicating via a plurality of lateral orifices 5 with an expansion tube 4 constituting the evaporator proper. The expander 4 is also closed at its base and, adjacent its closed upper end is provided with a single orifice 6 for discharging the vaporized liquid cryogen laterally and tangentially along the periphery of the diffuser.

The evaporator and expander are designed so that all of the liquid cryogen is transformed into gas before it enters the receptacle.

To provide an efficient heat exchange within the receptacle, the injector 1 and expander 4 are composed of thermally conductive material, e.g. metal, are rigid (preferably unitary) with one another and are connected by a metallic bond to the cylindrical diffuser ensuring effective heat exchange between the dispensed gas and the gas within the receptacle as well as with the sample. Thus the diffuser is a cylindrical metal sleeve with a vertical axis intimately connected to the tubes 1 and 4 and composed of a material having high thermal conductivity such as silver, aluminum or copper.

The evaporating assembly also comprises a tube 7 which communicates with the principal injector 1 and adapted to receive a temperature sensor which responds directly to the temperature of the supplied liquefied gas. The device also comprises a horizontal metal plate 8 connected by a bracket 3 to the cylinder 2 and underlying the cylinder to support the base of the sample tube which has been shown in broken lines in FIG. 1. The bracket 3 is composed of thermally insulating material, such as an acrylic resin to avoid thermal resonance between the cylinder 2 and the plate 8.

The latter is also formed with a pair of upstanding metal tubes 9 and 10, one of which can be provided with a sensor for a temperature readout giving the instantaneous temperature value while the other receives a sensor for long-term recordal of the temperature.

The entire assembly is received in a double-wall receptacle 11 of the Dewar type, the receptacle 11 consisting of silvered glass walls which are provided with one or more sets of windows 25 enabling observation of the contents of the sample tube. Another set of windows on the opposite side can serve to illuminate the sample tube.

Figure 3:
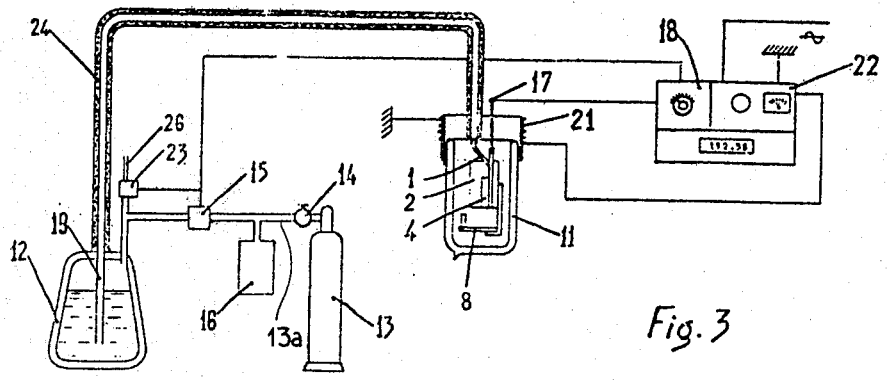
FIG. 3 is a flow diagram showing how the device of FIGS. 1 and 2 is incorporated into a cryogenic system.

The cryostat of FIGS. 1 and 2, is connected as shown in FIG. 3 to a source 12 of the liquid cryogen which can be, for example, anhydrous liquefied air or nitrogen. The thermally insulated tube 24, which draws the liquefied air from the bottom of the Dewar flask forming the vessel 12, is connected directly to the principal injector 11. Above the liquid cryogen in the flask 12, the latter is connected to a compressed air bottle 13 via a line 13*a* so that the pressurizing air is controlled by an electrically operated valve 15. The compressed air passes in the usual manner through a pressure reduction and exchange valve 14. An expansion chamber 16 is also connected to the line 13*a*.

The temperature sensor 17 is shown to be inserted into the receptacle 7 provided for this purpose on the evaporator and is electrically connected to the control circuit 18 regulating the valve 15 in response to the temperature input.

The compressed air from bottle 13 serves to drive the liquefied air, in its liquid phase, from the flask 12 through the riser 19 immersed therein, and the insulated tube 24 to the injector 1. The expansion and pressure-reducing valve 14 ensures that the liquid will be delivered at low pressure when the valve 15 opens in response to the temperature via the controller 18.

The liquefied air is delivered to the expander 4 where it is transformed into gas which is discharged into the receptacle 11.

The controller 18 receives the measured temperature as an actual value signal and compares it to the desired temperature and produces an error signal or difference signal (see FIG. 6) to operate the valve 15 in accordance with conventional servo-mechanism practices. If the temperature tends to drop below the set point setting, the valve 15 is closed and if it tends to rise above the set point setting, the valve 15 is opened.

Another electrically operated valve 23 is mounted between the flask 12 and a vent tube to permit the flask 12 to be connected to the atmosphere. Valve 23 is also operated by the controller 18 reciprocally with valve 15, i.e. valve 23 opens as valve 15 is closed and valve 23 closes as valve 15 opens, thereby controlling the compression or decompression in flask 12 to match the supply of liquid which the controller 18 determines is neccessary to establish the selected temperature. Icing of the valve 23 is also avoided in the system of the present invention even if the vent valve is provided close to the solenoid because of the heat generated by the latter.

The temperature of the entire interior of the Dewar receptacle 11 is reduced by the expansion of the liquified gas and hence the sample on plate 8 is bathed therewith.

The cold-diffusion surface of cylinder 2, rigid with the injectors 1 and 4, accelerates homogenization of the temperature within the receptacle 11.

Since the pressure in receptacle 11, because of the continuous expansion and evaporation of the liquefied gas in the expander 4 is slightly higher than atmospheric pressure, air at the mouth of the vessel 11 cannot carry moisture into the vessel to condense and ice up on the sample. Interference with heat exchange by insulating layers of ice is excluded. The transparent windows 25 permit viewing of the sample without being obscured by ice.

The cold gases emerging from the mouth of the vessel tend to produce a cloud of moisture or ice when these gases meet ambient air, this cloud being an annoyance to the operator.

I have found that cylindrical resistance heater 21 disposed above the mouth of the receptacle 11 can eliminate this problem.

The control unit can have a power supply 22 to supply the electrical resistive heater 21 in response to the moisture content of the atmosphere.

It should be noted that the resistance heater 21 plays no role in control of the cryogenic temperature, but rather only serves to prevent the formation of ice at the mouth of the vessel which might otherwise disturb the operator.

When cryogenic operations are complete, this resistance element or another resistance element may be used to raise the temperature in the interior of the receptacle 11. It is also possible to cover the receptacle 11 with an insulating member to avoid clouding at the mouth and in this case a single orifice may be provided for supplying the liquid cryogen while another orifice may vent the gas and can be connected to a location remote from the experiment site. This latter connection can be made by an insulated tube.

The control unit 18, 22 is provided with a dial upon which the desired temperature can be set with a meter which can show the instantaneous temperature, the latter being derived from a sensor received in tube 9.

Figure 4:
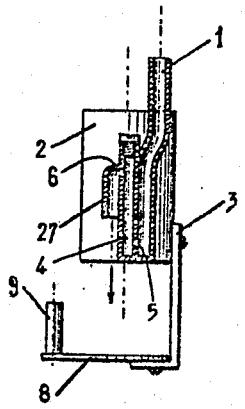
FIG. 4 is a side-elevational view, partly broken away of another evaporator system according to the invention.

FIG. 4 shows a variant of the evaporator in which the expanding tube 4 has its orifice 6 communicating with a deflector tube 27 whose outlet is turned toward the sample-support plate. In this case, the temperature sensor can be introduced into the expansion tube 4 rather than the injector tube 1. This system has been shown to provide a more rapid response to temperature change with slight reduction in precision in maintaining the temperature constant.

The expander may be in the form of a number of tubes similar to tube 4 disposed along the respective generatrices of the diffusion sleeve 2 or in the form of another sleeve surrounding sleeve 2 from which the gas is discharged via peripherally spaced holes all along the perimeter of the diffuser 2.

The system of the present invention can maintain a precision of 0.1° C. with temperatures between 0° C. and the boiling point of the liquefied gas, i.e. as low as −180° C. for liquefied air for medical, scientific and industrial research, such as the study of the composition of living cells, superconductivity or gas separations for gases whose vapor pressures are close to one another. The system has also been used effectively for crystallization, vitrification and even ultra-violet analysis thanks to the absence of interfering ice or liquid between the viewing window and the sample.

Figure 5:
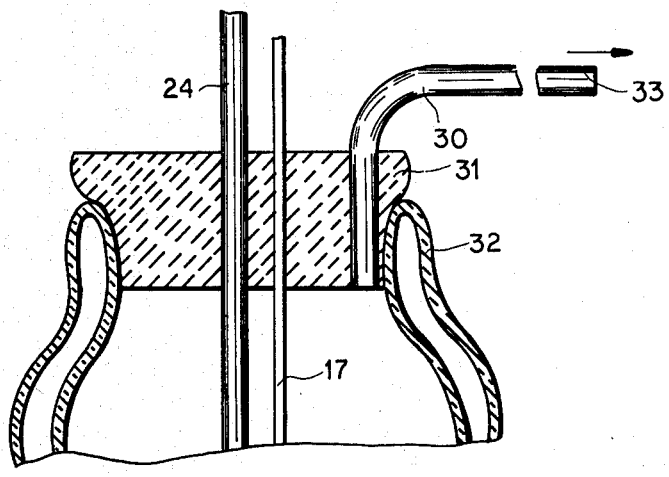
FIG. 5 is a cross-sectional view showing the top of a Dewar flask containing the assembly of FIGS. 1 and 2 (not here shown) according to another embodiment of the invention.

As can be seen from FIG. 5, the vessel 11 can be formed with a neck 32 provided with a thermally insulating plug 31 having a thermally insulated tube 30 which opens at 33 remote from the receptacle and test site. The plug is also traversed by the tube 24 connected to the injector 1 and the sensor 17 running to the well 7.

Figure 6:
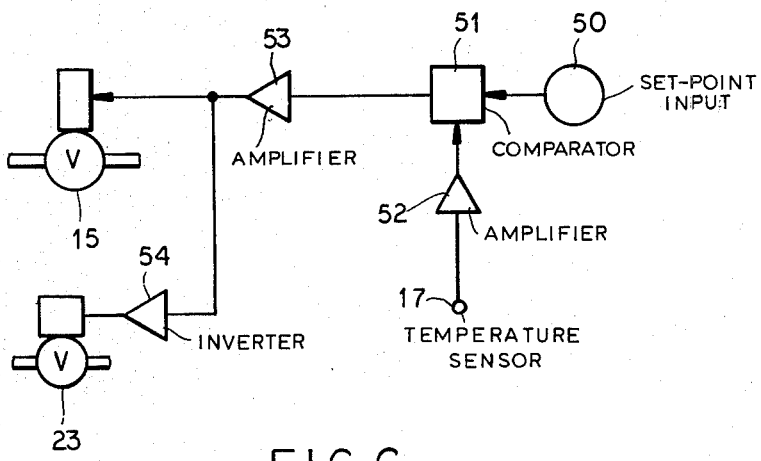
FIG. 6 is a diagram showing features of the control circuit according to the invention.

As can be seen from FIG. 6, a set point generator 50 can be provided in the control unit 18 to set the desired temperature reading at a comparator 51 which also receives the signal from the temperature sensor 17 via an amplifier 52. The difference signal is applied by amplifier 53 to the valve 15 and to an inverter 54 connected to the valve 23 for operation of the two valves 15 and 23 in reciprocal senses.

I claim:

1. A cryogenic apparatus comprising:

an open-top insulating receptacle;

a sample support in said receptacle for holding a sample to be subjected to a predetermined low temperature;

evaporating means for vaporizing a liquid cryogen disposed in the region of said support in said receptacle;

means responsive to temperature in said receptacle; and control means for controlling the feed of said liquid cryogen to said evaporating means in response to said means responsive to temperature to establish said predetermined temperature and maintain the same solely by the control of the supply of said liquid cryogen to said evaporating means, said liquid cryogen being supplied to said evaporating means at a rate sufficient to maintain a pressure of the vaporized cryogen sufficient to exclude moisture-carrying air from said receptacle.

2. A cryogenic apparatus comprising:

an open-top receptacle;

a sample support in said receptacle for holding a sample to be subjected to a predetermined low temperature;

evaporating means for vaporizing a liquid cryogen disposed in the region of said support in said receptacle;

means responsive to temperature in said receptacle; and control means for controlling the feed of said liquid cryogen to said evaporating means in response to said means responsive to temperature to establish said predetermined temperature and maintain the same solely by the control of the supply of said liquid cryogen to said evaporating means, said liquid cryogen being supplied to said evaporating means at a rate sufficient to maintain a pressure of the vaporized cryogen sufficient to exclude moisture-carrying air from said receptacle, said everaporating means comprising a vertical injector tube, a vertical expander tube disposed adjacent said injector tube and communicating therewith via a lateral orifice in said tubes, said expander tube having a vertical axis, a diffusor cylinder secured to said tubes, said liquid cryogen being fed to said injector tube, said tubes being constructed and arranged to fully vaporize said liquid cryogen before said cryogen is admitted to said before said cryogen is admitted to said receptable, and means for receiving a temperature sensor connected to said control means.

3. The apparatus defined in claim 2 wherein said tubes lie along at least one generatrix of said cylinder, said evaporating means having a discharge orifice being disposed substantially midway of the height of said cylinder.

4. The apparatus defined in claim 3 wherein said discharge orifice is trained substantially tangentially to the exterior of said periphery.

5. The apparatus defined in claim 3, further comprising a deflector mounted in said expansion tube ahead of said discharge orifice and training the flow therefrom downwardly.

6. The apparatus defined in claim 3, further comprising a support mounted on said cylinder and receiving a sample tube containing a sample and traversing said cylinder, said support being provided composed of metal but being thermally insulated from said cylinder, said support being formed at least with one well for receiving a temperature sensor.

7. The apparatus defined in claim 2 wherein said receptacle is a Dewar flask open to the atmosphere.

8. The apparatus defined in claim 7 wherein said receptacle is formed with a neck having a cover provided with a tubular outlet opening to the atmosphere remote from the receptacle.

9. The apparatus defined in claim 2, further comprising a tubular electrical resistance heater surrounding the mouth of said receptacle.

10. A cryogenic apparatus comprising:

an insulating receptacle;

a sample support in said receptacle for holding a sample to be subjected to a predetermined low temperature;

evaporating means for vaporizing a liquid cryogen disposed in the region of said support in said receptacle;

means responsive to temperature in said receptacle;

control means for controlling the feed of said liquid cryogen to said evaporating means in response to said means responsive to temperature to establish said predetermined temperature and maintain the same solely by the control of the supply of said liquid cryogen to said evaporating means, said liquid cryogen being supplied to said evaporating means at a rate sufficient to maintain a pressure of the vaporized cryogen sufficient to exclude moisture-carrying air from said receptacle;

a flask containing said liquid cryogen connected by an insulated tube to said evaporating means;

an electrically operated valve connected between said source and said flask and operated by said control means; and an expansion chamber connected between said source and said valve.

11. The apparatus defined in claim 10, further comprising a vent valve for venting said flask to the atmosphere, said valves being connected for reciprocal operation by said control means.

12. The apparatus defined in claim 10 wherein said receptacle is a Dewar flask open to the atmosphere.

13. The apparatus defined in claim 12 wherein said receptacle is formed with a neck having a cover provided with a tubular outlet opening to the atmosphere remote from the receptacle.

* * * * *